US007982730B2

(12) United States Patent
Correa et al.

(10) Patent No.: US 7,982,730 B2
(45) Date of Patent: Jul. 19, 2011

(54) METHOD AND APPARATUS FOR POWER CONTROL IN A DISPLAY DEVICE

(75) Inventors: Carlos Correa, Villingen-Schwenningen (DE); Cédric Thebault, Villingen-Schwenningen (DE); Rainer Zwing, VS-Villingen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1175 days.

(21) Appl. No.: 11/593,734

(22) Filed: Nov. 7, 2006

(65) Prior Publication Data

US 2007/0103397 A1 May 10, 2007

(30) Foreign Application Priority Data

Nov. 10, 2005 (EP) ..... 05292395

(51) Int. Cl.
*G09G 5/00* (2006.01)

(52) U.S. Cl. ..... 345/212; 345/60; 345/61; 345/62; 345/63

(58) Field of Classification Search ..... 45/212, 45/60–63

See application file for complete search history.

(56) References Cited

U.S. PATENT DOCUMENTS

| | | | | |
|---|---|---|---|---|
| 5,757,343 | A | 5/1998 | Nagakubo | |
| 6,380,943 | B1 | 4/2002 | Morita et al. | |
| 2004/0212565 | A1 * | 10/2004 | Ide | 345/60 |

FOREIGN PATENT DOCUMENTS

| | | | |
|---|---|---|---|
| EP | 0841652 | | 5/1998 |
| EP | 1149374 | | 10/2001 |
| JP | 06-259034 | * | 9/1994 |
| WO | WO00/46782 | | 1/2000 |

OTHER PUBLICATIONS

Search Report dated Apr. 24, 2006.

* cited by examiner

*Primary Examiner* — Richard Hjerpe
*Assistant Examiner* — Leonid Shapiro
(74) *Attorney, Agent, or Firm* — Robert D. Shedd; Jeffrey M. Navon

(57) ABSTRACT

The invention relates to a new method for power level control of a display device and an apparatus for carrying out the method. Classically, the contrast/brightness control and the power management (based on an average power level control) are made independently. These two controls can be contradictory. According to the invention, the power level mode and more particularly the number of sustain pulses within the video frame is selected as a function of the average power level (APL) of the picture to be displayed and the picture control signal representing the desired contrast and/or brightness value.

9 Claims, 3 Drawing Sheets

METHOD AND APPARATUS FOR POWER CONTROL IN A DISPLAY DEVICE

This application claims the benefit, under 35 U.S.C. §119 of EP Patent Application 05292395.0 filed 10 Nov. 2005.

FIELD OF THE INVENTION

The invention relates to a method for power level control of a display device and an apparatus for carrying out the method.

More specifically the invention improves contrast and environment light operating ranges of display devices like plasma display panels (PDP) and all kind of display devices based on the principle of duty cycle modulation (pulse width modulation) of light emission, at the same time that picture quality is kept approximately constant for the whole range and substantially improved for the low contrast value settings.

BACKGROUND OF THE INVENTION

Today, the Plasma technology makes possible to achieve flat colour panel of large size (out of the CRT limitations) and with very limited depth without any viewing angle constraints. Like CRT (Cathode Ray Tube) technology, PDP is a technology that generates its own light. In the same way, both technologies use a power management (or brightness regulation) circuit which allows a higher peak white brightness value than a full white value.

The CRT screens use a so called ABL (for Average Beam-current Limiter) circuit, which is implemented by analog means usually in the video controller, and which decreases video gain as a function of average luminance usually measured over an RC stage.

The plasma display panels use a so called APL (for Average Power Level) control circuit that generates less or more sustain pulses as a function of the average power level of the displayed picture. The APL control starts from the reflection that for larger peak white luminance values in plasma displays more sustain pulses are necessarily required. On the other hand, more sustain pulses correspond also to a higher power consumption of the PDP. Thus the solution is a control method which generates more or less sustain pulses as a function of the average picture power, i.e. it switches between different modes with different power levels. Such an APL control circuit is described in the international patent application WO 00/46782. For pictures having relatively low picture power, i.e. a lot of pixels with relatively low luminance value, a mode will be selected which uses a high number of sustain pulses to create the different video levels because the overall power consumption will be limited due to a great amount of pixels with low luminance value. For pictures having relatively high picture power, i.e. a lot of pixels with relatively high luminance value, a mode will be selected which uses a low number of sustain pulses to create the different video levels because the overall power consumption will be high due to a great amount of pixels with high luminance value. Thus, a plurality of power level modes can be defined for a good management of the power consumption.

The APL control is implemented as follows: first the average video level of the input signal after de-gamma is computed. This value is a good estimation of the total luminance power required for reproducing the input picture. Secondly, by means of a look-up table, the total number of sustain pulses that can be generated for the input picture to keep the power consumption in an authorized range is determined and a corresponding subfield organisation is simultaneously selected.

As described in the international patent application WO 00/46782, the sub-field organisations can vary in respect to one or more of the following characteristics:

the number of sustain pulses;

the number of sub-fields;

the sub-field positioning, . . . .

As mentioned before, this APL control allows a higher peak-white value without overloading the set power supply but it can have a functioning that is not compatible with the contrast and/or brightness control defined by the user or defined automatically according to the user viewing conditions (day-time viewing vs. evening-time viewing with dimmed environment light). Indeed when the user decreases the contrast of the picture, the APL control increases the number of sustain pulses within the video frame and when the user tries to increase the contrast of the picture, the APL control decreases the number of sustain pulses. So, these two controls are contradictory. Furthermore, in recent years, this problem has become more severe, because due to recent advantages in PDP technology, plasma brightness has improved, which requires a larger reduction in contrast in case of dark viewing environment.

SUMMARY OF THE INVENTION

It is an objective of the present invention to propose a new method and apparatus for power level control that does not have this problem.

According to the invention, it is proposed a new power control method wherein the subfield organisation (that corresponds to a power level mode) to be used for coding the picture data into subfield code words is selected, not only as a function of the average picture power level, but also as a function of the desired picture power to be displayed. The picture power is thus controlled by selecting an appropriate power level mode (with an appropriate number of sustain pulses within the frame) instead of modifying the video levels to be displayed.

The invention concerns a method for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame. It comprises:

- a step for determining a power value which is characteristic for the power level of the picture to be displayed,
- a step for selecting a picture control value which is characteristic for the contrast and/or brightness to be applied to said picture, and
- a step for selecting a power level mode based on said picture value and said power control value.

Advantageously, it further comprises a step for selecting a video gain value based on said power value and said picture control value and a step for applying said video gain value to the video levels of the pixels of the picture to be displayed. This video gain value is particularly useful when the number of sustain pulses required to obtain the desired picture power is lower than the number of sustain pulses of any one of the power level modes.

The picture control value is based on a contrast value and/or a brightness value that can be selected by a user or derived from user viewing conditions.

The invention concerns also an apparatus for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel. The apparatus comprises:

- a measurement circuit for measuring a power value which is characteristic for the power level of the picture to be displayed, and
- a first selection circuit for selecting a picture control value which is characteristic for the contrast and/or brightness to be applied to said picture,
- a second selection circuit for selecting one power level mode among a plurality of power level modes used for subfield coding based on said power value and said picture control value, wherein to each power level mode a characteristic subfield organization belongs, the subfield organizations being variable in respect to the number of sustain pulses during a frame, and
- a subfield coding circuit for coding the video levels of said picture into subfield code words based on the selected power level mode.

Preferably, the second selection circuit is also used for selecting a video gain value based on said power value and said picture control value. The video gain is applied to the video levels of the pixels of the picture to be displayed when the number of sustain pulses required to obtain the desired picture power is lower than the number of sustain pulses of any one of the power level modes. In that case, multiplier circuits are provided in the apparatus for applying said video gain value to the video levels.

In a preferred embodiment, the second selection circuit comprises:

- a first circuit for transforming the average picture power into a first number of sustain pulses,
- a second circuit for transforming the selected picture control value into a maximum allowed number of sustain pulses, a minimum allowed number of sustain pulses and a sustain gain,
- a third circuit for multiplying the first number of sustain pulses by said sustain gain and delivering a second number of sustain pulses,
- a fourth circuit for selecting the maximum number of sustain pulses between said second number of sustain pulses and said minimum allowed number of sustain pulses,
- a fifth circuit for selecting the minimum number of sustain pulses between said maximum number of sustain pulses and said maximum allowed number of sustain pulses, and
- a sixth circuit for transforming said minimum number of sustain pulses into a power level mode and a video gain value.

The first selection circuit can be an ambient light detector delivering a brightness and/or contrast value as a function of the user viewing conditions and/or a contrast/brightness selector controlled by the user.

BRIEF DESCRIPTION OF THE DRAWINGS

Exemplary embodiments of the invention are illustrated in the drawings and are explained in more detail in the following description. In the drawings.

DESCRIPTION OF PREFERRED EMBODIMENTS

Figure 1:
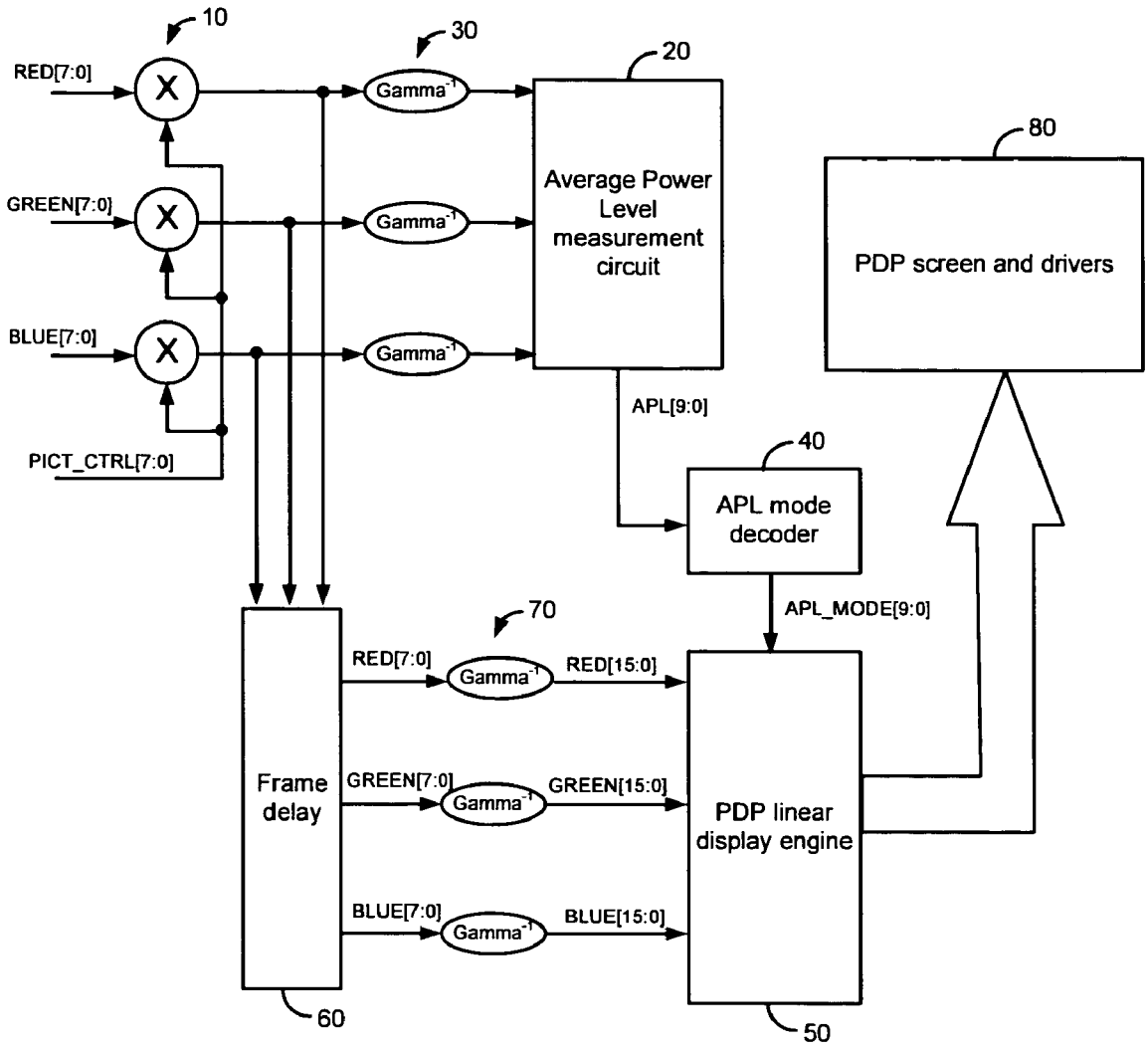
FIG.1 (prior art)
FIG. 1 shows a block diagram of a power level control device of a Plasma display Panel of the prior art.

FIG. 1 shows a block diagram of a power control device of a Plasma display Panel of the prior art. It comprises an APL control circuit for controlling the power consumption of the panel and a picture control circuit for controlling the contrast/brightness of the picture to be displayed. These two circuits work independently.

The picture power control is made by modifying the levels of the input video signals of the picture to be displayed. So it consists in multiplying the input video signals RED[7:0], GREEN[7:0], BLUE[7:0] by a picture control signal PICT_CTRL[7:0] representative of a picture power selected by the user. This picture control circuit is implemented by the multiplier circuits 10.

The APL control consists in computing the average power of the picture to be displayed and selecting an appropriate power level mode (corresponding to a subfield organization) for sub-field coding to have a good management of the power consumption.

In reference to FIG. 1, the video signals RED[7:0], GREEN[7:0], BLUE[7:0] outputted by the multipliers 10 are provided to an Average Power Level computation circuit 20 after a de-gamma processing 30. The APL computation circuit 20 outputs a 10-bit APL signal, called APL[9:0], that is representative of the total luminance power required for displaying the input picture. The average power value APL[9:0] of a picture can be calculated by simply summing up the pixel values for all video input data and dividing the result through the number of pixel values multiplied by three. The signal APL[9:0] is then used by an APL mode decoder 40 for converting it into a power level mode, called APL_MODE[9:0], representing a subfield organization. In practice, the APL mode decoder 40 is a simple Look Up Table. Different examples of power level modes are given here:

Mode 204: 204 sustain pulses (full white)
Mode 205: 205 sustain pulses
. . .
Mode 700: 700 sustain pulses
Mode 1000: 1000 sustain pulses For clarity reasons, the number of sustain pulses of a power level mode given in this example is identical to the mode number. The sustain pulses are distributed among the different subfields of the video frame. This distribution is not described because it does not have consequences on the power consumption.

The input video signals RED[7:0], GREEN[7:0], BLUE[7:0] outputted by the multipliers 10 are also provided to a PDP display engine 50 after being delayed by a frame delay circuit 60 and a de-gamma processing 70. Indeed input video signals have to be de-gammed by because the PDP display engine 50 has a linear gamma transfer function (the displayed brightness is proportional to number of generated sustain pulses). They also have to be delayed from a frame duration in order that the power level mode APL_MODE[9:0] determined by the decoder 40 corresponds to the video data supplied to the PDP display engine 50.

So the linear display engine 50 receives three 16-bit de-gammed input video signals RED[15:0], GREEN[15:0], BLUE[15:0] and the 10-bit APL mode value APL_MODE[9:0] that controls the number of sustain pulses to be generated. The subfield organization selected by the signal APL_MODE [9:0] is used by the display engine 50 for coding the video signals RED[15:0], GREEN[15:0], BLUE[15:0] and the signals outputted by the display engine 40 are then provided to the PDP drivers 80 for displaying the corresponding images.

As mentioned before, the picture control part and the APL control part are working independently and it can result into contradictory actions. According to the invention, the power level mode is selected as a function of the average power level of the image to be displayed and the picture power control selected by the user or defined by an ambient light sensor.

Figure 2:
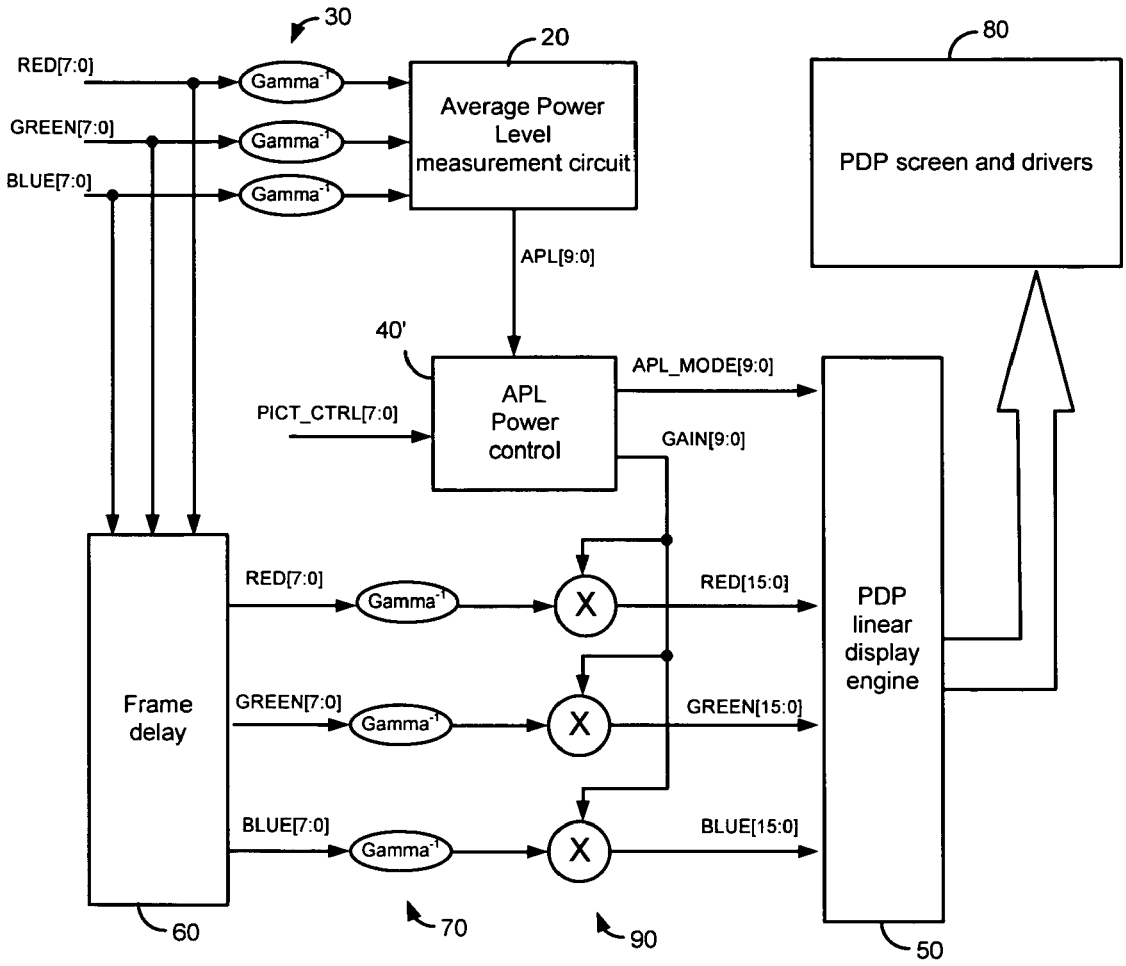
FIG. 2 shows a block diagram of a power level control device of a Plasma display Panel according to the invention.

FIG. 2 shows a block diagram of a power level control device of a Plasma display Panel according to the invention. The same reference signs are used in FIGS. 1 and 2 for the identical circuit blocks. In the FIG. 2, the multipliers 10 are removed and the APL mode decoder 40 is replaced by an APL control circuit 40' that receives, in addition to the signal APL[9:0], the picture control signal PICT_CTRL[7:0]. The circuit 40' delivers the power level mode signal APL_MODE [9:0] and advantageously a video gain signal GAIN[9:0]. The power level mode signal APL_MODE[9:0] is used by the display engine 50 for subfield coding. The video gain GAIN [9:0] is applied to the video signals RED[15:0], GREEN[15:0], BLUE[15:0] by means of multiplier circuits 90.

Basically the function of the APL power control circuit 40' is to modify the power level mode defined by the APL control in accordance with the picture control PICT_CTRL[7:0] selected by the user or defined as a function of the user environment light. The mode selected will have at most the same number of sustain pulses than the mode selected by the APL mode decoder of FIG. 1. The basic principle of this circuit is to increase or decrease the picture power by changing the value of the total number of sustain pulses within a frame, i.e. by selecting an appropriate power level mode.

Figure 3:
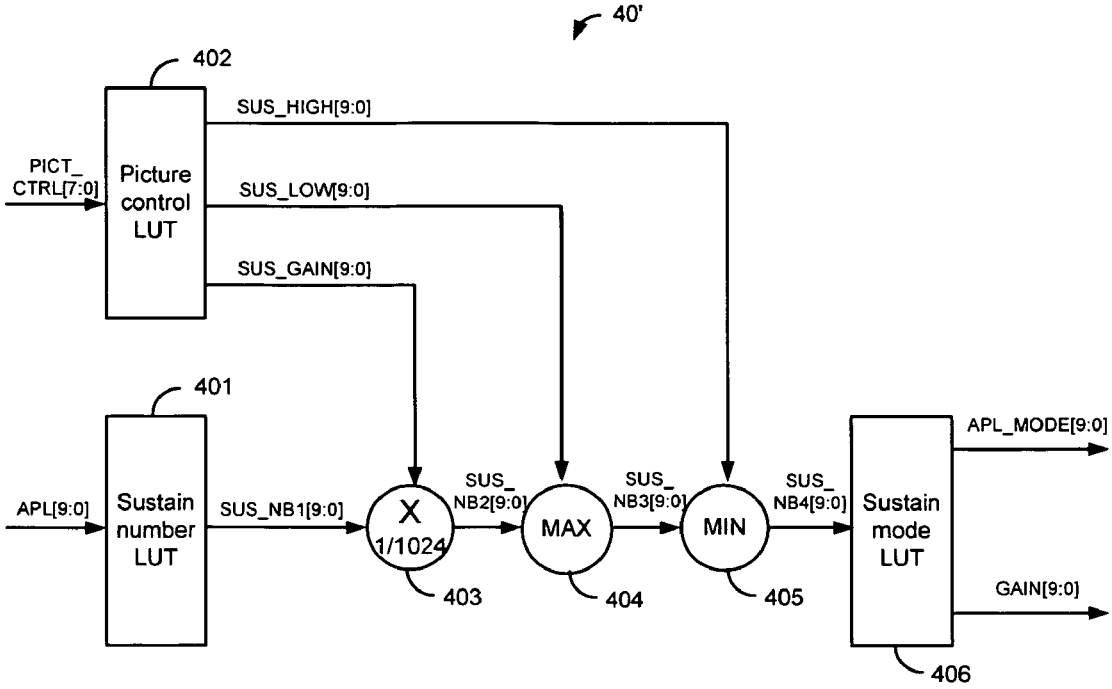
FIG. 3 shows a block diagram of an APL power control circuit of the device of FIG. 2.

FIG. 3 shows a block diagram of the APL control circuit 40'. The circuit comprises a first look up table 401 for transforming the APL value APL[9:0] into a first number of sustain pulses SUS_NB1[9:0] corresponding to the number of sustain pulses of a power level mode adapted to the considered APL value. It comprises also a second look up table 402 that converts each picture control value PICT_CTRL[7:0] into three values:

- a gain factor SUS_GAIN[9:0] that is used for decreasing the total number of sustain pulses SUS_NB1[9:0]; its value decreases as the value of the picture control value PICT_CTRL[7:0] decreases;
- a number of sustain pulses SUS_HIGH[9:0] that is the highest allowed number of sustain pulses allowed for applying the desired picture control; this number is high when the picture contrast and/or brightness should be high and it is low when the picture contrast and/or brightness should be low; and
- a number of sustain pulses SUS_LOW[9:0] that is the lowest number of sustain pulses allowed for applying the desired picture control; this number is in practice equal to the number of sustain pulses by the APL control for a full white picture except when the highest allowed number of sustain pulses SUS_HIGH[9:0] is low; In that case, this number SUS_LOW[9:0] is lower than the number of sustain pulses by the APL control for a full white picture;

The number of sustain pulses SUS_NB1[9:0] is then multiplied by the gain SUS_GAIN[9:0] by the means of a multiplier circuit 403. It delivers a second number of sustain pulses SUS_NB2[9:0]. In the example of FIG. 3, the gain factor SUS_GAIN[9:0] is comprised between 0 and 1023 in order to have gain factors with enough precision for different picture control values. Consequently, the gain factor SUS_GAIN[9:0] is divided by 1024 in the multiplier circuit 304.

The second number of sustain pulses SUS_NB2[9:0] is then compared to the highest allowed number of sustain pulses SUS_LOW[9:0] by a circuit 404 that selects the maximal value between these two values. The number of sustain pulses, referenced SUS_NB3[9:0], outputted by the circuit 404 is then compared to the highest allowed number of sustain pulses SUS_HIGH[9:0] by a circuit 405 that selects the minimal value between these two values. Finally, the number of sustain pulses, referenced SUS_NB4[9:0], outputted by the circuit 405 is converted by a sustain mode look up table 406 into a power level mode APL_MODE[9:0] as defined before and a gain value GAIN[9:0] representing a gain factor to be applied to the video input signals RED[15:0], GREEN [15:0], BLUE[15:0]. Regarding the power level mode APL_MODE[9:0], if the LUTs 401 and 406 were directly connected in series, they were equivalent to the APL mode decoder 40 of the FIG. 1.

The gain factor GAIN[9:0] is required when the number of sustain pulses SUS_NB4 is lower than the number of sustain pulses of the power level mode with the lowest number of sustain pulses (corresponding to a full white picture mode). For example, when the number SUS_NB4 is equal to 150 and the mode with the lowest number of sustain pulses have 200 sustain pulses, the mode selected by the LUT 406 will be this mode and the gain factor GAIN[9:0] will be equal to 150/200=¾. Since brightness is proportional to the number of sustain pulses, this gain has to be introduced where the video data is linear, i.e., after the de-gamma function as shown in FIG. 2.

The proposed circuit is to be used to reduce the PDP picture power in relation to the nominal value of the PDP panel specification ratings (which are usually max values) and should not be used to increase it in order to prevent overloading of the power supply.

Examples of the signals PICT_CTRL[7:0], SUS_GAIN[9:0], SUS_LOW[7:0] and SUS_HIGH[9:0] are given below. In this table, it is supposed that the video frame comprises 200 sustain pulses for a full white picture and 1000 sustain pulses for a peak white picture. For the sake of simplicity, a reduced number (16) of picture power control values, PICT_CTRL[7:0], instead of 256 picture power control values are given. The picture power control values can be selected by the user or come from an ambient light sensor. They can also be a mix of these two commands. A high picture power control value indicates that a high brightness and/or contrast is requested. On the contrary, a low picture power control value indicates that a low brightness and/or contrast is requested.

| PICT_CTRL [7:0] | SUS_HIGH[9:0] (peak white) | SUS_GAIN[9:0] (intermediate) | SUS_LOW[9:0] (full white) |
|---|---|---|---|
| 15 | 1000 (sustain pulses) | 1023 (1/1024) | 200 (sustain pulses) |
| 14 | 900 | 1023 | 200 |
| 13 | 800 | 1023 | 200 |
| 12 | 750 | 900 | 200 |
| 11 | 700 | 800 | 200 |
| 10 | 700 | 750 | 200 |
| 9 | 700 | 700 | 200 |
| 8 | 650 | 650 | 200 |

-continued

| PICT_CTRL [7:0] | SUS_HIGH[9:0] (peak white) | SUS_GAIN[9:0] (intermediate) | SUS_LOW[9:0] (full white) |
|---|---|---|---|
| 7 | 600 | 600 | 200 |
| 6 | 550 | 550 | 200 |
| 5 | 500 | 500 | 200 |
| 4 | 450 | 450 | 200 |
| 3 | 350 | 350 | 200 |
| 2 | 250 | 250 | 150 |
| 1 | 150 | 150 | 100 |
| 0 | 50 | 50 | 50 |

These values are given as an example and many other possibilities are allowed. The PDP manufacturer has in fact the freedom to decide how the power is reduced in terms of full white picture and peak white picture power levels. The factor POWER_SUSTAIN_GAIN[9:0] is provided for specifying the power gain to be used for the intermediate modes comprised between the mode corresponding to a full white picture and the mode corresponding to a peak white picture.

The invention presented here is an improvement of the classical power management circuit. It proposes a simple and easy way for having a power management of the panel which is not in contradiction with the picture power selected by a user or by an ambient light sensor. More particularly, the present invention is an efficient way to adapt the panel operation to the actual user viewing conditions (day-time viewing vs. evening-time viewing with dimmed environment light). The APL power control circuit 40' can be combined with an ambient light measuring cell for an automatic regulation of the contrast or brightness. In that case, we have

PIC_CTRL[7:0]=AMBIENT_LIGHT[7:0]

The power control circuit can also be used for implementing user picture contrast regulation. In that case, we have:

PIC_CTRL[7:0]=USER_CONTRAST[7:0].

If the power control circuit is to be used in combination of both ambient light measuring cell and user contrast setting we can make:

PIC_CTRL[7:0]=(AMBIENT_LIGHT[7:0]*USER_CONTRAST[7:0])/256

In this way it allows for a simple and natural way of adapting displayed picture luminance power to the actual viewing environment and contrast setting, without reducing number of displayed video levels.

This invention improves also picture quality because the number of discrete video levels available for coding video is higher if compared to the solution where brightness or contrast is controlled exclusively by means of video gain on the input side.

The blocks shown in all the figures can be implemented with appropriate computer programs rather than with hardware components. Furthermore, the invention is not restricted to the disclosed embodiments.

Various modifications are possible and are considered to fall within the scope of the claims. e.g. other values of maximum or minimum allowed number of sustain pulses SUS_HIGH[9:0] or SUS_LOW[9:0] or other values of gain SUS_GAIN[9:0] can be used.

The invention can be used for all kinds of displays which are controlled by using a PWM like control of the light emission for grey-level variation.

The invention claimed is:

1. Method for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame, and having a step for determining a power value which is characteristic for the power level of the picture to be displayed, comprising:

a step for selecting a picture control value which is characteristic for the contrast and/or brightness to be applied to said picture, a transformation of the average picture power of the input picture into a first number of sustain pulses, a transformation of the selected picture control value into a maximum allowed number of sustain pulses, a minimum allowed number of sustain pulses and a sustain gain, a multiplication of the first number of sustain pulses by said sustain gain and delivering a second number of sustain pulses a selection of the maximum number of sustain pulses between said second number of sustain pulses and said minimum allowed number of sustain pulses, a selection of the minimum number of sustain pulses between said maximum number of sustain pulses and said maximum allowed number of sustain pulses and a transformation of said minimum number of sustain pulses into a power level mode and a video gain value for selecting a power level mode based on said power value and said picture control value.

2. Method according to claim 1, wherein it further comprises a step for applying said video gain value to the video levels of the pixels of the picture to be displayed.

3. Method according to claim 1, wherein the picture control value is based on a contrast value and/or a brightness value.

4. Method according to claim 3, wherein said contrast value or a brightness value is selected by a user and/or derived from user viewing environment light conditions.

5. Apparatus for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame, and having means for determining a power value which is characteristic for the power level of the picture to be displayed, said apparatus comprising:

a measurement circuit for measuring a power value which is characteristic for the power level of the picture to be displayed, a first circuit for selecting a picture control value which is characteristic for the contrast and/or brightness to be applied to said picture and transforming the average picture power of the input picture into a first number of sustain pulses, a second circuit for transforming the selected picture control value into a maximum allowed number of sustain pulses, a minimum allowed number of sustain pulses and a sustain gain a third circuit for multiplying the first number of sustain pulses by said sustain gain and delivering a second number of sustain pulses a fourth circuit for selecting the maximum number of sustain pulses between said second number of sustain pulses and said minimum allowed number of sustain pulses a fifth circuit for selecting the minimum number of sustain pulses between said maximum number of sustain pulses and said maximum allowed number of sustain pulses and a sixth circuit for transforming said minimum number of sustain pulses into a power level mode and a video gain value.

6. Apparatus according to claim 5, wherein the second circuit also comprises multiplier circuits for multiplying said video gain value to the video levels of the pixels of the picture to be displayed.

7. Apparatus according to claim 5, wherein the first, second and sixth circuits are look-up tables.

8. Apparatus according to claim 5, wherein the first circuit comprises an ambient light detector.

9. Apparatus according to claim 5, wherein it is included in a display device, in particular a plasma display device.

* * * * *